US008845295B2

(12) United States Patent
Yamashita et al.

(10) Patent No.: US 8,845,295 B2
(45) Date of Patent: Sep. 30, 2014

(54) TURBINE BUCKET

(75) Inventors: Yutaka Yamashita, Hitachi (JP); Shigeki Senoo, Hitachi (JP); Eiji Saito, Hitachi (JP); Takeshi Kudo, Hitachinaka (JP); Tateki Nakamura, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 1147 days.

(21) Appl. No.: 12/018,556

(22) Filed: Jan. 23, 2008

(65) Prior Publication Data

US 2008/0206065 A1 Aug. 28, 2008

(30) Foreign Application Priority Data

Jan. 26, 2007 (JP) ..... 2007-015739

(51) Int. Cl.
*F01D 5/14* (2006.01)
*F01D 5/22* (2006.01)

(52) U.S. Cl.
CPC . *F01D 5/141* (2013.01); *F01D 5/22* (2013.01)
USPC ..... 416/223 A

(58) Field of Classification Search
USPC ..... 416/195, 196 R, 189, 241 R, 223 A, 243
See application file for complete search history.

(56) References Cited

U.S. PATENT DOCUMENTS

| | | | | |
|---|---|---|---|---|
| 5,480,285 | A * | 1/1996 | Patel et al. | 416/223 A |
| 6,341,941 | B1 * | 1/2002 | Namura et al. | 416/190 |
| 6,682,306 | B2 | 1/2004 | Murakami et al. | |
| 2006/0118215 | A1 | 6/2006 | Hirakawa et al. | |
| 2006/0222501 | A1 * | 10/2006 | Nogami et al. | 416/219 R |

FOREIGN PATENT DOCUMENTS

| | | | |
|---|---|---|---|
| JP | 62253 | B | 6/1923 |
| JP | 04-005402 | A | 1/1992 |
| JP | 2003-065002 | | 3/2003 |
| JP | 2005-194626 | A | 7/2005 |

* cited by examiner

*Primary Examiner* — Edward Look
*Assistant Examiner* — Jesse Prager
(74) *Attorney, Agent, or Firm* — Mattingly & Malur, PC

(57) ABSTRACT

A turbine bucket for a steam turbine low-pressure final stage has an exhaust area exceeding 9.6 $m^2$ and 13.8 $m^2$ in steam-turbine final-stage buckets for a rated speed 3600 rpm and 300 rpm machines, respectively. The turbine bucket is made of martensite steel. A blade portion of the turbine bucket has a suction surface 7 and a pressure surface 8 which are each formed, at a turbine blade root, of three areas consisting of a steam inlet side area 12 with curvature, a steam outlet side area 13 with curvature and an approximately straightly formed area located between the two areas.

3 Claims, 7 Drawing Sheets

TURBINE BUCKET

BACKGROUND OF THE INVENTION

1. Field of the Invention

The present invention relates to a steam turbine equipped with a turbine bucket applied to a low-pressure turbine final stage and more particularly to a steam turbine used in a thermal electric power plant or the like.

2. Description of the Related Art

In recent years, steam turbines are required to deal with high-power and cost reduction. To meet such requirements, the method is often adopted to increase an area of a turbine bucket through which steam passes (hereinafter called the exhaust area) by increasing the length of the bucket of a low-pressure turbine final stage.

By increasing the exhaust area to increase the amount of steam flowing along the turbine bucket, the power of the steam turbine can be increased and power produced per casing of a low-pressure turbine can be increased. Thus, the number of low-pressure casings of the steam turbine in an output spectrum, which is conventionally two, can be reduced to one, thereby achieving a remarkable cost reduction.

One of the major problems involved in the increased length of a bucket of a low-pressure turbine final stage is that high centrifugal stress occurs in a blade portion or a dovetail during rotation of the turbine bucket. As an example that dealt with the problem, there is a case where the blade portion is made of a titanium alloy lighter than a steel-based material in order to reduce a centrifugal force acting on the blade (see JP-A-2003-65002). However, the titanium alloy is inferior to the steel-based alloy in cost or the like.

SUMMARY OF THE INVENTION

A blade made of a steel-based material may be intended to be increased in length. In such a case, a sectional area of the blade at each blade-height (the sectional area of the blade as viewed from the radially outer-side at a certain blade-height) must be increased from the blade root to the blade tip according to centrifugal force acting on each blade-height so that the centrifugal stress acting on the blade may not exceed a limit value of material strength. The material density of the steel-based material is approximately twice that of the titanium alloy. The cross-section of the blade root needs to fully carry the centrifugal force caused by the weight of the blade. Thus, a significantly large sectional area is required. This case poses the following problems: since the shape of the blade root becomes large, a sufficient width of a steam passage cannot be ensured; and since the weight of the blade becomes too large, high centrifugal stress occurs in the dovetail. This therefore necessitates a shape of the blade root that can ensure the steam passage and a dovetail that can resist high centrifugal stress.

Another of the major problems involved in the increased length of a bucket of a low-pressure turbine final stage is vibration of the turbine bucket. In general, the turbine bucket is constantly excited in a wide range of frequency by the flow of working fluid (steam) and by a disturbing component of the flow. The vibration response of a blade structure to such exciting force is influenced by a natural vibration frequency and the size of damping force at each vibration mode. The rigidity of a blade lowers with increased length of the blade, which lowers the natural vibration frequency, increasing the vibration response.

It is an object of the present invention to provide a turbine bucket that can make centrifugal stress acting on a blade portion or dovetail not greater than a limit value of a material and that is provided with a shape of blade root that can ensure a steam passage even if the blade is increased in length in order to increase an exhaust area.

It is another object of the present invention to provide a turbine blade that can reduce vibration response of the blade occurring during operation.

The present invention is characterized in that a blade portion of a turbine bucket has a suction surface and a pressure surface which are each formed, at a turbine blade root, of three areas consisting of a steam inlet side area with curvature, a steam outlet side area with curvature, and an area put between the two areas with the suction surface and the pressure surface formed in approximately straight lines.

In addition, the present invention is characterized in that the turbine bucket is formed at a tip portion with a first connection member extending to a suction side of the blade portion and to a pressure side thereof and is formed between a root of the turbine bucket and the first connection member with second connection member extending to the suction side of the blade portion and the pressure side thereof, and in that the turbine bucket is formed at a root portion with a dovetail inserted into a corresponding one of a plurality of grooves which are straightly cut from a rotor-axial end face side so as to be located on a turbine disk outer portion of a rotor and arranged in a blade rotating direction.

The present invention can provide a turbine bucket provided with a shape of the blade root that can make centrifugal stress acting on a blade or dovetail not greater than a limit value of a material even if the blade is increased in length in order to increase an exhaust area and that can ensure a steam passage. Further, the present invention can provide a turbine bucket that can reduce vibration response of a blade portion occurring during operation.

In particular, the present invention can provide a steel (martensite steel) turbine bucket that can make centrifugal stress acting on a blade or dovetail not greater than a limit value of a material, has such a superior damping characteristic as to reduce vibration response of the blade portion occurring during operation, and has an exhaust area exceeding 9.6 $m^2$ in steam turbine final stage buckets for a rated speed 3600 rpm machine or exceeding 13.8 $m^2$ in steam turbine final state buckets for a rated speed 3000 rpm machine.

EXPLANATION OF REFERENCE NUMBERS

Figure 1:
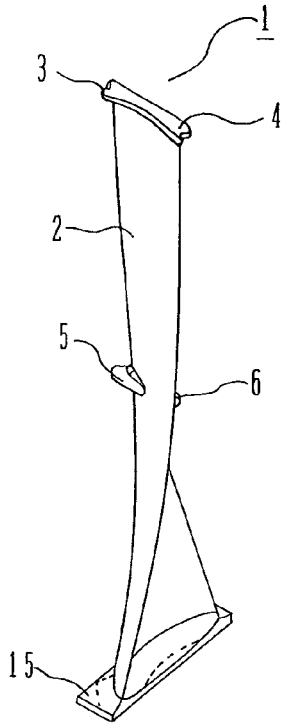
FIG. 1 is a perspective view illustrating a bucket of a steam turbine according to an embodiment of the present invention.

1 . . . Bucket
2 . . . Blade portion
3 . . . Integral cover portion (suction side)
4 . . . Integral cover portion (pressure side)
5 . . . Tie-boss (suction side)
6 . . . Tie-boss (pressure side)
7 . . . Suction surface
8 . . . Pressure surface
9 . . . Blade leading edge
10 . . . Blade trailing edge
11 . . . Straight area
12 . . . Inlet-side curve area
13 . . . Outlet-side curve area
14 . . . Passage width
15 . . . Platform
22 . . . Disk
23 . . . Disk groove
24 . . . Dovetail
26 . . . Rotor
27 . . . Stator blade
28 . . . External casing
29 . . . Main steam

DETAILED DESCRIPTION OF THE PREFERRED EMBODIMENTS

A description will hereinafter be made of preferred embodiments of the present invention with reference to the drawings.

FIG. 1 is a perspective view illustrating a bucket of a steam turbine according to an embodiment of the present invention. In FIG. 1, there are shown a bucket (blade) or rotor blade 1, a blade portion 2 twisted from a blade root to a blade tip, an integral cover portion (a first connection member on a blade suction side) 3 provided at the blade tip portion so as to extend toward the blade suction side, and an integral cover portion (a first connection member on a blade pressure side) 4 provided at the blade tip portion so as to extend toward the blade pressure side. In addition, there are shown a tie-boss (a second connection member on the blade suction side) 5 projecting on the blade suction side of a blade intermediate portion, a tie-boss (a second connection member on the blade pressure side) 6 projecting on the blade pressure side of the intermediate portion, and a platform 15. The integral cover portions 3 and 4 and the tie-bosses 5 and 6 are each formed integrally with the blade portion 2. The tie-bosses 5 and 6 are often provided close to the central portion (½ of the blade length) in the blade length direction. However, they may be provided closer to the blade tip side or to the blade root side than the blade-lengthwise central portion so as to deal with the torsional stiffness of the blade portion or the like. Also, the tie-bosses 5 and 6 are often provided at an almost central portion between the leading edge and trailing edge of the blade on the axial line of a rotor. The bucket according to the embodiment of the present invention is formed of martensite steel.

The platform 15 forms the radially inner surface of a steam passage. The circumferential width of the platform 15 is generally formed to have a blade pitch t. The turbine axial width of the platform 15 is formed larger than the turbine axial width BW of the blade (see FIG. 2).

Figure 2:
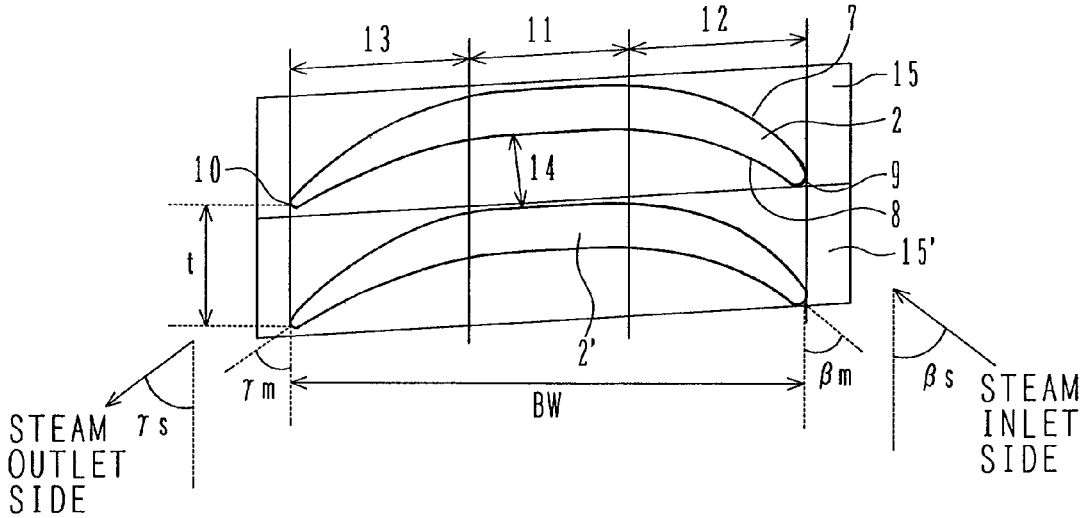
FIG. 2 is a plan view illustrating airfoils in blade root section according to the embodiment of the present invention.

A description is made of an airfoil, in blade root section, of the bucket according to the embodiment of the present invention with reference to FIG. 2.

A suction surface 7 and a pressure surface 8 in blade root section according to the embodiment of the present invention are each formed to have a curve with a certain curvature extending from a blade leading edge 9 to a blade trailing edge 10 and including a curve area 12 (inlet-side curve area), a curve area 13 (outlet-side curve area) and an almost straight area 11 (straight area) connecting the curve areas 12 and 13.

When a final stage airfoil of a low-pressure turbine is to be determined, it is important to determine the sectional area of a blade tip and that of a blade root. The sectional area of the blade tip determines the weight of the blade tip, which determines centrifugal force acting on a portion below the blade tip. The sectional area of a radially lower side portion from the blade tip is determined so as to resist the centrifugal force. This is repeated from the blade tip to the blade root to determine the sectional area of the blade root.

In this way, the sectional area of the blade root can progressively be reduced as the weight of the blade tip is reduced. Thus, the weight of the entire blade can be reduced.

Figure 3:
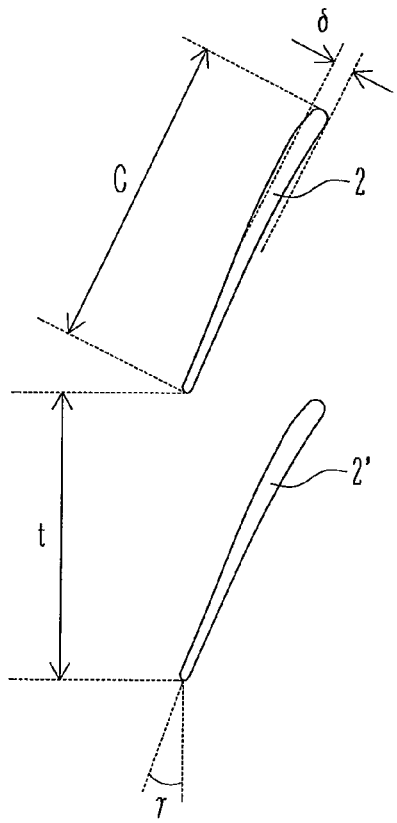
FIG. 3 is a plan view of airfoils of blade tips as viewed from the radially outer side.

FIG. 3 is a plan view of airfoils of blade tips as viewed from the radially outer side. The airfoil, in cross-section, of the blade tip is formed like a thin plate in terms of fluid performance. Thus, the sectional area of the blade tip is virtually determined by a blade chord C and an average blade thickness $\delta$. In terms of fluid performance, the blade chord C needs to be formed to meet $C \times \cos\gamma > t$ where a blade pitch is t and a blade outlet angle is $\gamma$. The average blade thickness $\delta$ has a machinable minimum value in terms of manufacture of the blade. Consequently, a reduction in the sectional area of the blade tip is naturally limited.

Figure 4:
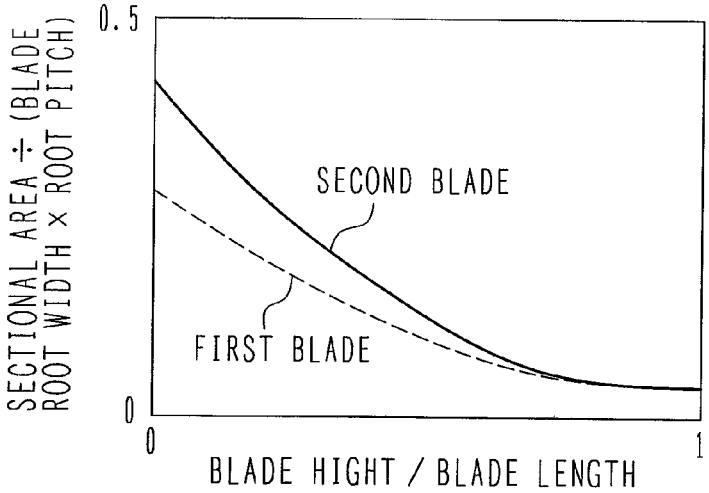
FIG. 4 illustrates the relationship between a sectional area of an airfoil and blade height position.

FIG. 4 plots the distribution of sectional areas in relation to every blade height position. FIG. 4 compares the sectional area distribution of a conventional blade (e.g. Hitachi Hyoron, 2006, 2 (Vol. 88 No. 2) p. 34, hereinafter called the first blade) with that of another blade (hereinafter called the second blade). The first blade is a steel bucket of a 3600 rpm machine and has an exhaust area of up to about 8.3 $m^2$. The second blade is a steel bucket of a 3600 rpm machine and has an exhaust area of about 9.6 $m^2$, which is obtained by the same calculation as that of the first blade. The abscissa axis represents a blade height made dimensionless by a blade length. The ordinate axis represents a sectional area made dimensionless by blade axial width BW×blade pitch t when the blade pitch=1 at the root of the first blade.

It is to be noted that although the steel blade of a 3600 rpm machine with an exhaust area of about 9.6 $m^2$ is herein taken as an example for explanation, the explanation given herein also applies in the same manner to a steel blade of a 3000 rpm machine with an exhaust area of about 13.8 $m^2$ on the basis of a scaling relation. In other words, the scaling relation can be established between the 3000 rpm machine and the 3600 rpm machine with respect to blades of the low-pressure final stage. For the 3000 rpm machine, a blade with a length 1.2 times (3600/3000) the length of the 3600-rpm-machine blade is used in inverse proportion to the rotational speed (e.g., a 40-inch blade of the 3600 rpm machine corresponds to a 48-inch blade of the 3000 rpm machine, and they are the same in shape but differ only in size). The scaling relation applies not only to the blades but to rotor external diameters, etc. Once the scaling relation is satisfied, it also applies to performance and vibration properties between the blades of the two machines. Therefore, designing either of the blades of the 3000 rpm machine or of the 3600 rpm machine is substantially equivalent to designing both of them. When the blade of the 3000 rpm machine is to be designed, its blade length is 1.2 times that of the 3600 rpm machine as mentioned above, resulting in an exhaust area 1.44 times (1.2×1.2) as large as that of the 3600-rpm-machine blade; accordingly, if an exhaust area of the 3600-rpm-machine blade is 9.6 $m^2$, the exhaust area of the 3000-rpm-machine blade is about 13.8 $m^2$ (9.6×1.2×1.2).

The sectional area distribution of the second blade in FIG. 4 reveal that the sectional area of the tip of the second blade is approximately equal to that of the first blade (strictly, since the blade length and pitch t of the second blade is different from those of the first blade, the sectional area of the tip of the second blade is slightly larger than that of the first blade). However, in view of the sectional area of the root, it is necessary to increase the sectional area by about 40% with respect to the first blade.

The sectional shape of the blade root is next described. The requirements of the airfoil are as below in terms of fluid performance. The passage width 14 between the blades shown in FIG. 2 is ensured; in other words, the thickness of the blade is made small. An inlet angle βm and outlet angle γm of the blade are made to match with an inflow angle βs and outflow angle γs, respectively, of fluid as much as possible. The passage width 14 between the blades is continuously reduced from the steam inlet side toward the outlet side. The curvatures of the suction surface and pressure surface of the blade are not made large. The change of the curvature is not made large.

In terms of strength the airfoil needs to be placed on the platform 15 without protruding therefrom.

In order to ensure the passage width 14 between the blades through which steam flows, in terms of fluid performance, it is necessary to set an average thickness ratio of the blade at 0.35 or less. This average thickness ratio of the blade is obtained by making the blade average thickness Tb dimensionless with respect to the pitch t between adjacent blades. The blade average thickness Tb is represented in the formula, Tb=A/BW, where A is the blade sectional area and BW is blade turbine axial width. The average thickness ratio of the blade is equivalent to the sectional area shown in FIG. 4.

In the convention blades including the first blade, a ratio of the blade turbine axial directional width BW at the blade root section to the blade pitch t, BW/t, is equal to about 4. If the turbine axial width BW of the second blade is made equal to that of the conventional blade, the average thickness ratio of the second blade is equal to about 0.42. To set the average thickness ratio at 0.35 or less, it is desirable that the ratio of the blade turbine axial width BW to the blade pitch t, BW/t, be made equal to 5 (=4×0.42÷0.35) or more.

It is desirable that the inlet angle βm of the blade leading edge 9 and the outlet angle γm of the blade trailing edge 10 be determined to approximately match with the inflow angle βs and outflow angle γs, respectively, of steam. In addition, it is desirable that the suction and pressure surfaces, 7 and 8, of the blade be each formed to have a curve without an abrupt change of curvature, i.e., with gentle curvature. However, if it is intended that the inlet angle βm of the blade leading edge 9 and the outlet angle γm of the blade trailing edge 10 match with the inflow angle βs and outflow angle γs, respectively, of steam and further the suction and pressure surfaces of the blade be each formed to have a curve with gentle curvature close to uniform curvature, the blade will have a large camber so that it cannot be mounted on the platform 15.

On the other hand, in order to mount the blade on the platform 15, the suction surface 7 and pressure surface 8 of the blade excluding the inlet-side curve area 12 and outlet-side curve area 13 of the blade may each be intended to have a curve with an approximately uniform curvature. In such a case, since the inlet angle βm of the blade leading edge and the outlet angle γm of the blade trailing edge are made matched with the inflow angle βs and outflow angle γs, respectively, of steam, the curvatures at each of the blade inlet side and outlet side are abruptly increased. At a portion with a large curvature, flow may abruptly be accelerated to thereafter develop a boundary layer. In the worst case, the boundary layer may separate from the suction surface of the blade on the blade outlet side or blade inlet side. Thus, performance may be likely to deteriorate significantly.

To overcome this, the embodiment of the present invention adopts an airfoil as shown in FIG. 2. This airfoil is such that the suction surface and pressure surface of the blade at the blade root of the turbine bucket are each formed of the three areas: the steam-inlet-side area with curvature, the steam-outlet-side area with curvature, and the area put between the two areas with the suction surface and the pressure surface formed in approximately straight lines. By this adoption, the passage width 14 is ensured, and additionally the suction surface 7 and pressure surface 8 in blade root section can each be formed to allow the inlet angle βm and outlet angle γm of the blade to match with the inflow angle βs and outflow angle γs, respectively, of steam, and to have a gentle curve surface without an abrupt curvature, thereby satisfying performance. Incidentally, from this viewpoint, the "approximate straight" in the straight area can be interpreted as the range where, with the passage width 14 ensured first, the suction surface 7 and pressure surface 8 in blade root section can each be formed to allow the inlet angle βm and outlet angle γm of the blade to match with the inflow angle βs and outflow angle γs, respectively, of steam and to have a gentle curve surface without an abrupt curvature.

Figure 5:
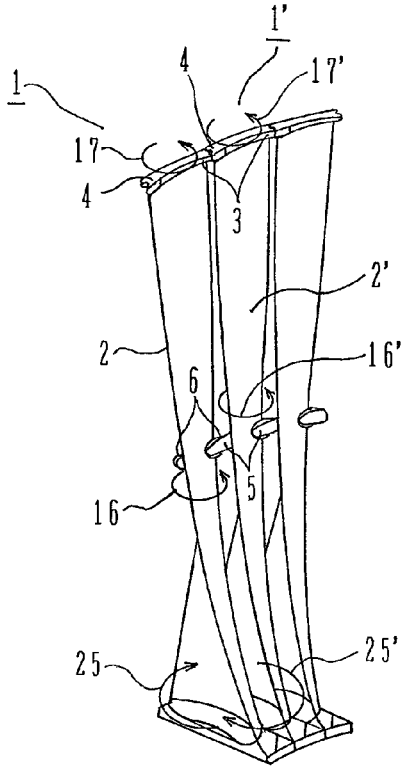
FIG. 5 is a perspective view illustrating force acting during operation on the bucket of the steam turbine according to the embodiment of the present invention.
Figure 6:
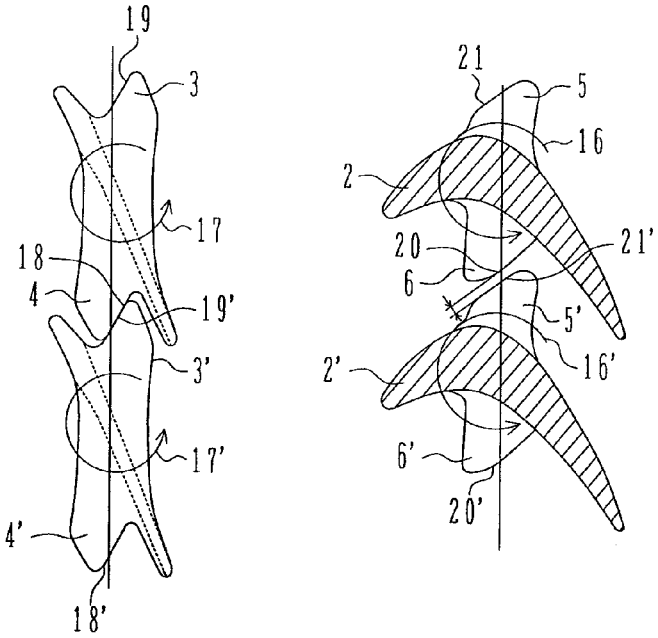
FIG. 6 is a plan view of integral covers and tie-bosses according to the embodiment of the present invention, as viewed from the radially outer side.

FIG. 5 is a perspective view illustrating force acting on the bucket during operation according to the embodiment of the present invention. FIG. 6 is a plan view of integral covers and tie-bosses of the bucket according to the embodiment of the present invention as viewed from the radially external side. As rotation of the rotor is increased, a centrifugal force acts on the blade portion 2 from the blade root toward the blade tip. Since the blade portion 2 is twisted, the centrifugal force causes untwisting in the blade portion 2. In FIG. 5, arrow symbol 17 denotes the direction of an untwisting moment acting on a blade tip portion of the bucket 1. Arrow symbol 17' denotes the direction of an untwisting moment acting on a blade tip portion of a bucket 1' adjacent to the bucket 1 with respect to the circumferential direction of the rotor. In addition, arrow symbol 16 denotes the direction of an untwisting moment acting on the blade intermediate portion of the bucket 1, and arrow symbol 16' denotes the direction of an untwisting moment acting on the blade intermediate portion of the bucket 1'.

Opposed surfaces 18 and 19 (18' and 19') of the integral covers of the adjacent blades and opposed surfaces 20 and 21 (20' and 21') of the tie-bosses of the adjacent blades are formed to restrain the untwisting moments acting on the blades during rotation. The adjacent buckets 1 and 1' are connected with each other by bringing the adjacent surfaces 18 and 19' into contact with each other during rotation.

The adjacent blades are connected each other over the full circumference of the blades to have a vibration characteristic as a full circumferential group of blades. The natural vibration frequency of the blade is significantly increased compared with the case where the blades are not connected to each other, with the result that low, first-order bending frequency which is likely to increase vibration response of the blade disappears. In addition, joining together the blades by bringing their surfaces into contact with each other produces an effect that the friction of the surfaces reduces the vibration response.

One of the problems resulting from the increased length of the blade is lowered rigidity of the blade, which lowers the natural vibration frequency, thereby increasing the vibration response. However, the blade connection structure of the present embodiment according to the invention can reduce the vibration response.

Further, if the airfoil in blade-root cross-section shown in FIG. 2 is adopted, the turbine axial width BW of the blade is increased. The increased axial width BW of the blade can increase the natural vibration frequency of low, first-order bending vibration for the full circumferential group of blades, which increases the vibration response of a blade.

Thus, the blade connection structure and airfoil in the blade root section shown in the present embodiment further can reduce the vibration response of the blade.

Figure 7:
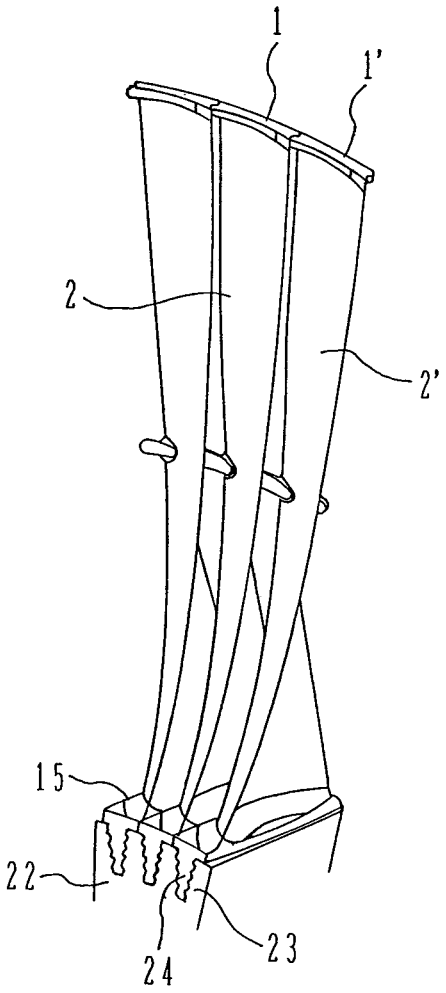
FIG. 7 is a perspective view illustrating buckets of the steam turbine according to the embodiment of the present invention mounted to a rotor.

FIG. 7 is a perspective view illustrating the buckets of the steam turbine mounted to a rotor according to the embodiment of the present invention. Referring to FIG. 7, reference numeral 22 denotes a cylindrical disk provided on the outer circumference of the rotor, and 23 denotes disk grooves provided in the disk 22. A plurality of the disk grooves 23 are provided in the blade-rotating direction of the disk. The disk groove 23 is a groove straightly cut from the axial end face side and formed to extend in the axial direction of the turbine or to slant with respect to the axial direction of the turbine. The dovetail (the axial entry type) 24 of the bucket 1 is formed to be fitted into the disk groove 23. The dovetail 24 of the bucket 1 is fitted into the disk groove 23 for engagement, whereby the centrifugal force acting on the bucket 1 is carried by the rotor. The disk 22 is formed to extend along the circumferential direction (rotational direction) of the rotor, and several tens of the buckets 1 are formed on the circumference of the rotor. The platform 15 is formed in a rectangle as viewed from the radially outer side so as to have suction and pressure side circumferential end faces approximately parallel to the longitudinal direction of the dovetail 24. Alternatively, if the disk groove 23 is formed to slant with respect to the turbine axial direction, the platform 15 is formed in a parallelogram. The bucket 1 is formed on the radially outer side of the platform 15, and the dovetail 24 is formed on the radially inner side of the platform 15.

Since the axial-entry-type dovetail 24 shown in FIG. 7 can be formed small, not only can the weight of the blade be reduced, but also the sectional area of the dovetail carrying centrifugal stress can be enlarged. Thus, the axial-entry-type dovetail is superior in centrifugal strength property.

One of the problems caused by the increased length of the blade is increased centrifugal stress of the dovetail due to the increased weight of the blade and to the increased centrifugal stress. However, the adoption of such a dovetail can achieve the reduced weight of the blade and the reduced centrifugal stress.

Figure 8:
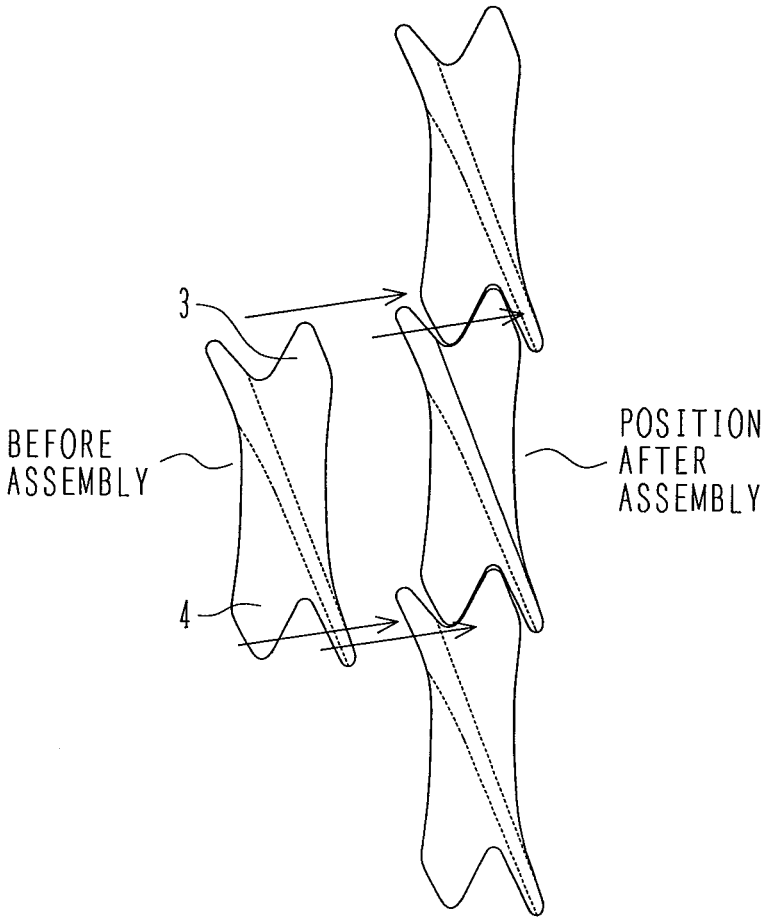
FIG. 8 is a plan view illustrating the middle of assembly of the turbine bucket according to the embodiment of the present invention.

FIG. 8 is a plan view for assistance in explaining the points to be considered in assembling the turbine bucket according to the embodiment of the present invention in the case of adopting the blade connection structure shown in FIG. 7. FIG. 8 is a plan view illustrating the integral cover portions 3 and 4 of the partial turbine buckets 1 out of the fully circumferentially arranged turbine buckets 1, as viewed from the radially outer side. Further, FIG. 8 illustrates the middle of sequential one-by-one assembly of the turbine buckets.

Referring to FIG. 8, it is assumed that the turbine buckets are sequentially assembled one by one. Since the integral cover portion 3 and 4 and the tie-boss portion 5 and 6 interfere with an adjacent blade, they cannot be assembled. To overcome this, all the blades in the circumference are collectively inserted into the corresponding disk grooves 23 for assembly by using a jig or the like installed on the outside of the turbine disk or by hooking the dovetails 24 of the buckets 1 on the ends of the disk grooves 23. If the dovetail 24 is straightly formed to extend in the axial direction of the turbine or to slant with respect to the axial direction of the turbine, the dovetails 24 can be inserted into the corresponding disk grooves 9 by the above assembly without interferences of the adjacent blades, of the integral cover portions 3 and 4 and of the tie-bosses 5 and 6.

Figure 9:
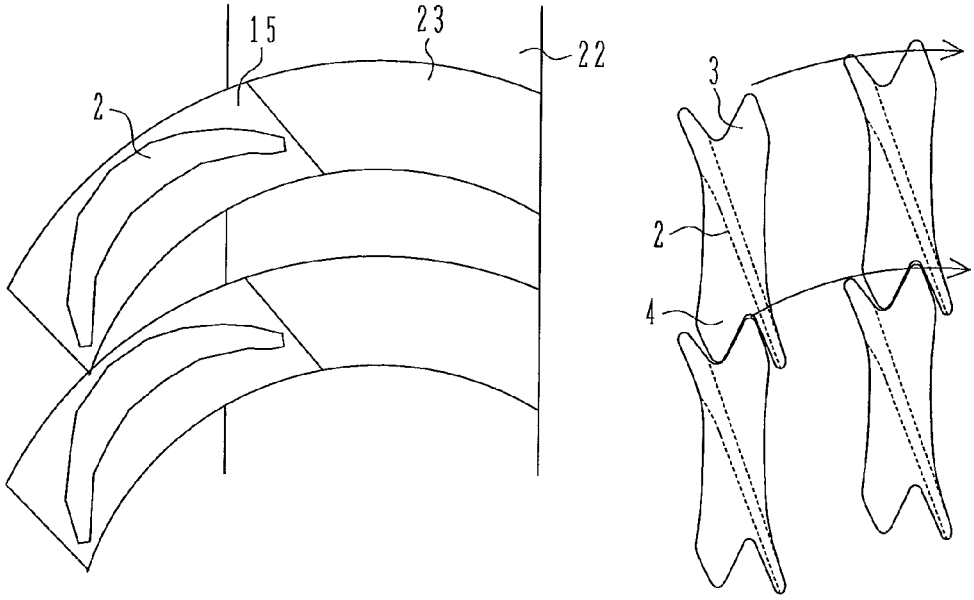
FIG. 9 is a plan view illustrating the middle of assembly of a turbine bucket of a conventional example, a platform and an integral cover being viewed from the radially outer side.

For comparison, FIG. 9 illustrates the middle of assembling conventional turbine buckets where dovetails 24 are inserted into circumferentially-bent curved-axial-entry grooves. FIG. 9 is a plan view illustrating a platform 15 and integral cover portions 3 and 4 of the turbine buckets as viewed from the radially outer side.

If all the blades in the circumference, each having the curved-axial-entry groove, are collectively inserted into corresponding disk grooves 9, they are each inserted along the circular arc of the disk groove 9. In view of the state where the blades are slightly inserted into the ends of the disk grooves 9, the blades are rotated clockwise when all of them are implanted. As shown in FIG. 9, since the suction side end face of a platform of a blade interferes with the pressure side end face of a platform of a blade adjacent to the suction side, turbine buckets cannot be assembled if nothing is done. It is therefore necessary to increase the circumferential pitch of the platforms of the blades having curved-axial-entry grooves compared with that of blades having the linearly formed axial entry grooves. In the case of a blade with increased length, if the suction surface and pressure surface of the conventional root airfoil are each intended to have a smooth curve as much as possible, the camber of the blade is increased. In order to increase the camber of the blade as much as possible and to place the airfoil in root section inside the platform, it is necessary to increase the circumferential pitch of the platforms of the blades.

As shown in FIG. 9, if the blades are rotated clockwise, the covers are rotated in the same way. Opposed surfaces of covers of adjacent blades interface with each other as with the platforms; therefore, it is necessary to increase a clearance between the surfaces so as to prevent the opposed surfaces of the covers from interfering with each other during assembly. This causes a large clearance between the surfaces of the adjacent covers during operation of the turbine after the assembly. This clearance increases an amount of steam flowing from inside the turbine blades to the radially outer side. Thus, performance is likely to deteriorate.

In contrast to this, to deal with the increased length of the blade, the embodiment of the present invention adopts the airfoil in blade root section shown in FIG. 2, the blade connection structure shown in FIGS. 5 and 6, and the blade grooves shown in FIG. 7. Thus, the performance of the blade in blade root section is satisfied, the vibration response of the blade can be reduced, and the superior centrifugal strength property can be obtained.

Figure 10:
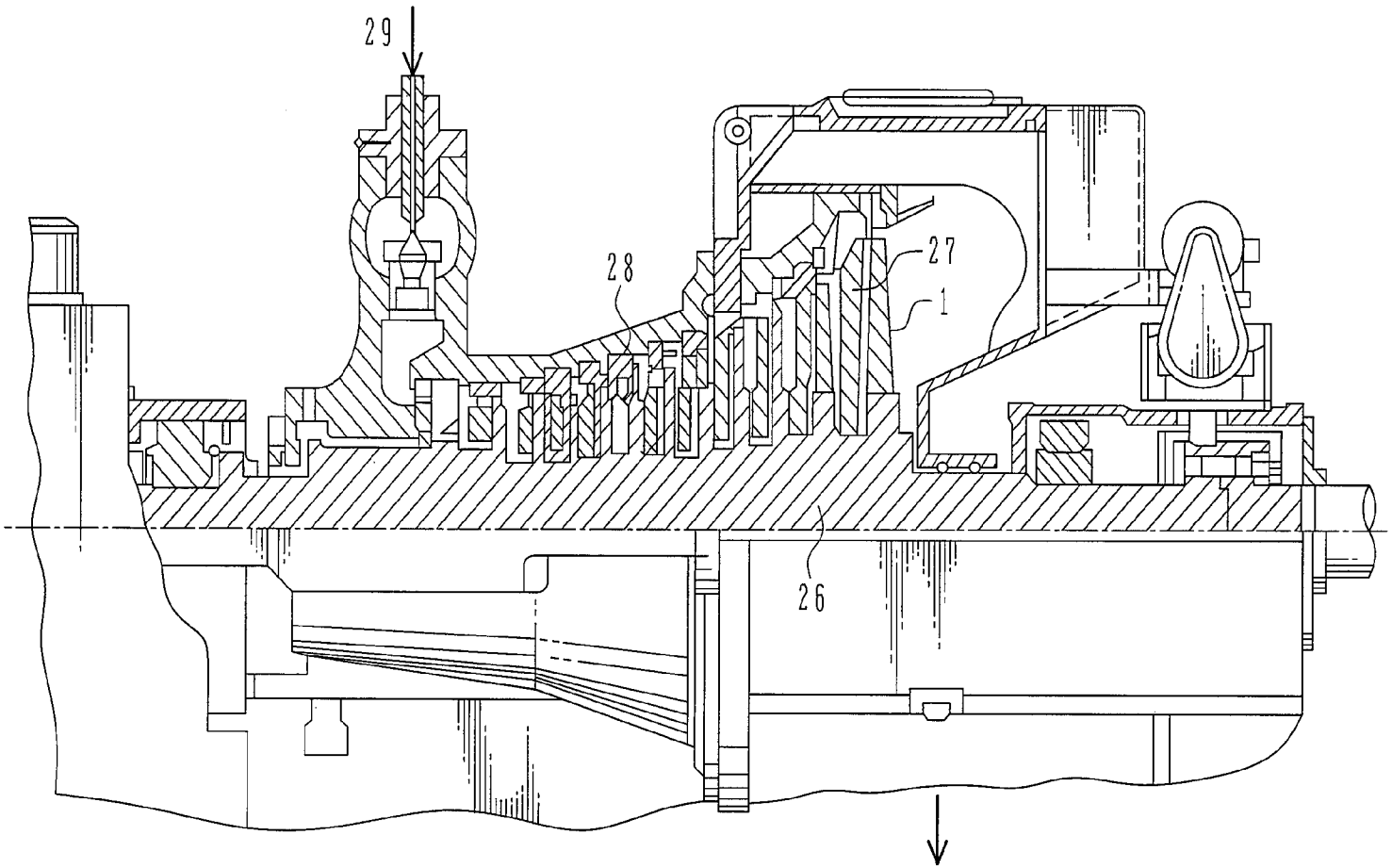
FIG. 10 is a configurational diagram of a steam turbine to which the turbine bucket according to the embodiment of the invention is applied.

FIG. 10 is a machine configuration diagram of a steam turbine to which the turbine buckets according to the embodiment of the invention is applied. The steam turbine of the present embodiment is used in a thermal electric power plant.

In FIG. 10 there are shown a rotor 26, stator blades (nozzles) 27, an external casing 28, and main steam 29. Several tens of the buckets 1 are provided on the same circumference of the rotor 26. The aggregate of the buckets on the same circumference of the rotor 26 is hereinafter called a "stage." Several of the stages are provided in the axial direction of the rotor 26. The buckets and the stator blades 27 provided on the external casing 28 so as to correspond to the buckets constitute the stage. The main steam 29 from a steam generator (not shown) is led to the buckets 1 by the stator blades 27 to rotate the rotor 26. A generator (not shown) is installed at one end of the rotor 26. The generator converts the rotational energy of the rotor into electric energy for electric power generation. In the steam turbine of the embodiment, the length of the bucket becomes larger as steam goes to lower stages. In other words, the bucket 1 of the final stage closest to a steam condenser is the largest in length and therefore lies under the strictest conditions in terms of intensity vibration. To deal with this, the steam turbine of the embodiment adopts the turbine buckets of the embodiment of the present invention described above as the buckets 1 of the final stage.

The steam turbine of the embodiment according to the invention can satisfy performance with respect to the blade root section, reduce the vibration response of the blade, and provide a superior centrifugal strength characteristic.

What is claimed is:

1. A steam turbine for use in a thermal electric power plant, the steam turbine comprising:

a steam turbine low-pressure final stage portion;

a turbine rotor supporting the steam turbine low-pressure final stage portion;

a plurality of turbine buckets forming the steam turbine low-pressure final-stage portion and having an exhaust area exceeding 9.6 $m^2$ in steam-turbine final-stage buckets for a rated speed 3600 rpm machine or exceeding 13.8 $m^2$ in steam-turbine final-state buckets for a rated speed 3000 rpm machine, each turbine bucket comprising:

a turbine blade having a blade root, a blade portion and a tip portion;

a platform formed at the blade root of each turbine bucket;

a dovetail formed on a radially inner side of the platform of each turbine bucket and being insertable into a corresponding one of a plurality of grooves which are each straight cut in a rotor axial end face side to locate each turbine bucket on a turbine disk outer portion of the turbine rotor and which grooves are arranged circumferentially on said rotor in a blade rotating direction, the platform being formed in a parallelogram shape, as viewed from a radially outer side, and having spaced suction and pressure side circumferential end faces which are each approximately parallel to a longitudinal direction of the dovetail, which longitudinal direction is a direction in which the dovetail is inserted into a corresponding one of the plurality of straight cut grooves; and a suction surface and a pressure surface of the blade portion of the turbine blade, each of which suction and pressure surfaces is formed, at the turbine blade root, of three areas consisting of a steam-inlet-side area with a first surface curvature, a steam-outlet-side area with a second surface curvature and an approximately straight formed center area located between, and connecting the steam-inlet-side area and the team-outlet-side area, in the blade root, a blade leading edge being positioned before, in the turbine rotor rotational direction relative to a blade trailing edge, and a passage width between adjacent ones of said turbine buckets, in the blade root, said passage width continuously decreasing, in the blade outlet direction, from the steam-inlet-side area, in the direction of steam flow, from the steam-inlet-side area to the steam-outlet-side area.

2. The steam turbine according to claim 1, wherein an airfoil of the turbine root is formed such that a relationship between a blade pitch t and a turbine-axial width BW of the blade portion is $BW/t \geq 5$.

3. The steam turbine according to claim 1, wherein the turbine bucket is formed of martensite steel; and wherein an airfoil of the turbine bucket root is formed such that a relationship between a blade pitch t and a turbine-axial width BW of the blade portion is $BW/t \geq 5$.

* * * * *